US007140432B2

(12) United States Patent
Gremillion

(10) Patent No.: US 7,140,432 B2
(45) **Date of Patent: *Nov. 28, 2006**

(54) DUAL DIAMETER AND ROTATING CENTRALIZER/SUB AND METHOD

(75) Inventor: Maximillian S. Gremillion, Missouri City, TX (US)

(73) Assignee: CaseTech International, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/175,126

(22) Filed: Jul. 5, 2005

(65) Prior Publication Data

US 2005/0241822 A1 Nov. 3, 2005

Related U.S. Application Data

(60) Division of application No. 10/302,641, filed on Nov. 23, 2002, which is a continuation-in-part of application No. 09/655,795, filed on Sep. 6, 2000, now Pat. No. 6,484,803.

(51) Int. Cl.
*E21B 17/10* (2006.01)

(52) U.S. Cl. ..... 166/241.6; 166/241.1; 166/242.6

(58) Field of Classification Search ..... 166/241.1, 166/241.6, 241.7, 242.6; 175/325.1, 325.2, 175/325.5
See application file for complete search history.

(56) References Cited

U.S. PATENT DOCUMENTS

| | | | | |
|---|---|---|---|---|
| 350,655 | A | 10/1886 | Brooder | |
| 1,314,070 | A | 8/1919 | Mc Kissick | |
| 1,565,518 | A | 12/1925 | Smyser | |
| 1,767,198 | A | 6/1930 | Baker | |
| 1,775,376 | A | 9/1930 | Steps et al. | |
| 1,812,945 | A | 7/1931 | Granger | |
| 1,998,833 | A | 4/1935 | Crowell | |
| 2,058,310 | A | 10/1936 | Hartman et al. | |
| 2,089,553 | A | 8/1937 | Hartman et al. | |
| 2,258,052 | A | 10/1941 | Hall | |
| 2,311,768 | A | 2/1943 | McCray | |
| 2,546,582 | A * | 3/1951 | Baker | 166/241.6 |

(Continued)

FOREIGN PATENT DOCUMENTS

DE G 89 03 038.9 5/1989

(Continued)

OTHER PUBLICATIONS

Patent Litigation: *Weatherford International, Inc. and Weatherford/Lamb, Inc., Plaintiffs, v. Casetech International, Inc., Defendant.* Civil Action No. H-03-CV-05383, In the United States District Court For the Southern District of Texas, Houston Division. "Claim Construction Memorandum and Order", Aug. 12, 2005, 10 pages.

(Continued)

*Primary Examiner*—George Suchfield
(74) *Attorney, Agent, or Firm*—Gordon G. Waggett, P.C.

(57) ABSTRACT

A dual diameter centralizing sub for maintaining stand-off and/or centralizing a tubular member inside a larger diameter tubular member, for instance, in a wellbore. The centralizer is provided with bow springs that compress into grooves between radially outwardly-extending vanes that are spaced around the outer diameter of the sub when compressive force is applied to the bow springs. The vanes extend radially outwardly far enough that the effective diameter of the sub in the area of the vanes is greater than the diameter of the sub and/or the tubing to which it is mounted to provide stand-off even under conditions in which the bow springs are fully compressed while still maintaining fluid flow.

4 Claims, 6 Drawing Sheets

U.S. PATENT DOCUMENTS

| | | | | | |
|---|---|---|---|---|---|
| 2,605,844 | A | | 8/1952 | Clark, Jr. | |
| 2,628,682 | A | | 2/1953 | Wright | |
| 2,640,544 | A | | 6/1953 | Baker | |
| 2,665,762 | A | | 1/1954 | Althouse, Jr. | |
| 2,666,241 | A | | 1/1954 | Hall, Sr. | |
| 2,718,266 | A | | 9/1955 | Berry et al. | |
| 2,824,613 | A | | 2/1958 | Baker et al. | |
| 2,828,824 | A | | 4/1958 | Cornstock | |
| 2,845,128 | A | | 7/1958 | Clark, Jr. et al. | |
| 2,898,136 | A | | 8/1959 | Hall, Sr. et al. | |
| 2,962,313 | A | | 11/1960 | Conrad | |
| 2,986,471 | A | | 5/1961 | Baker | |
| 2,998,848 | A | | 9/1961 | Wright et al. | |
| 3,065,005 | A | | 11/1962 | Hall, Sr. et al. | |
| 3,072,195 | A | | 1/1963 | Kluck | |
| 3,128,827 | A | | 4/1964 | Kluck | |
| 3,172,475 | A | | 3/1965 | Moore | |
| 3,196,951 | A | * | 7/1965 | Saurenman | 166/241.6 |
| 3,196,952 | A | | 7/1965 | Solum | |
| 3,200,884 | A | | 8/1965 | Solum | |
| 3,235,295 | A | | 2/1966 | Solum | |
| 3,237,696 | A | | 3/1966 | Hall | |
| 3,289,768 | A | | 12/1966 | Solum | |
| 3,360,846 | A | | 1/1968 | Schellstede et al. | |
| 3,556,042 | A | | 1/1971 | Laughlin | |
| 3,578,084 | A | | 5/1971 | Bombardieri et al. | |
| 3,614,139 | A | | 10/1971 | Harrison | |
| 3,978,924 | A | | 9/1976 | Roesner | |
| 4,011,907 | A | | 3/1977 | Clay | |
| 4,021,083 | A | | 5/1977 | Anderson | |
| 4,031,969 | A | | 6/1977 | Cullen et al. | |
| 4,039,026 | A | * | 8/1977 | Yonker | 166/117.5 |
| 4,042,022 | A | | 8/1977 | Wills et al. | |
| 4,077,470 | A | | 3/1978 | Dane | |
| 4,088,186 | A | | 5/1978 | Callihan et al. | |
| 4,133,470 | A | | 1/1979 | Trail | |
| 4,363,360 | A | | 12/1982 | Richey | |
| 4,520,869 | A | | 6/1985 | Svenson | |
| 4,523,640 | A | | 6/1985 | Wilson et al. | |
| 4,531,582 | A | | 7/1985 | Muse et al. | |
| 4,566,317 | A | | 1/1986 | Shakra | |
| 4,630,690 | A | | 12/1986 | Beasley et al. | |
| 4,651,823 | A | * | 3/1987 | Spikes | 166/241.7 |
| 4,688,636 | A | | 8/1987 | Hennessey | |
| 4,739,842 | A | | 4/1988 | Kruger et al. | |
| 4,787,458 | A | | 11/1988 | Langer | |
| 4,794,986 | A | | 1/1989 | Langer | |
| 4,880,066 | A | | 11/1989 | Steiginga et al. | |
| 4,984,633 | A | | 1/1991 | Langer et al. | |
| 4,995,456 | A | | 2/1991 | Cornette et al. | |
| 5,095,981 | A | | 3/1992 | Mikolajczyk | |
| 5,238,062 | A | | 8/1993 | Reinholdt | |
| 5,261,488 | A | | 11/1993 | Gullet et al. | |
| 5,339,896 | A | | 8/1994 | Hart et al. | |
| 5,575,333 | A | | 11/1996 | Lirette et al. | |
| 6,032,748 | A | * | 3/2000 | DeBray et al. | 175/325.7 |
| 6,209,638 | B1 | | 4/2001 | Mikolajczyk | |
| 6,457,519 | B1 | * | 10/2002 | Buytaert | 166/241.6 |
| 6,484,803 | B1 | | 11/2002 | Gremillion | |
| 6,679,325 | B1 | * | 1/2004 | Buytaert | 166/241.3 |

FOREIGN PATENT DOCUMENTS

| | | |
|---|---|---|
| EP | 0143219 | 6/1985 |
| GB | 664905 | 1/1952 |
| GB | 682292 | 11/1952 |
| GB | 682489 | 11/1952 |
| GB | 689807 | 4/1953 |
| GB | 698464 | 10/1953 |
| GB | 2249333 A | 5/1992 |
| GB | 2366580 | 3/2002 |

OTHER PUBLICATIONS

Baker, Ron, A Primer of Oilwell Drilling, pp. 119-146, 137 (6th Ed. 2001).

Ray Oil Tool Company—The Centralization Specialists—rayoiltool.com—one page product brochure regarding Bi-Centered Float Shoes, Collars & Inline Type Centralizers printed from this website on Sep. 13, 2004, but same material was printed previously from website on Feb. 25, 2003. Date of origin of this material and website is not known.

Patent Litigation: *Weatherford International, Inc. and Weatherford/Lamb, Inc., Plaintiffs, v. Casetech International, Inc., Defendant*. Civil Action No. H-03-CV-05383, In the United States District Court For the Southern District of Texas, Houston Division.

Information Disclosure Statement filed on Apr. 6, 2006 in Ex Parte Re-exam of Lirette, U.S. Pat. No. 5,575,333 (Control No. 5,575,333 (control No. 9/077,870 (27 pgs).

Halliburton's Patent Opinion on related U.S. Appl. No. 10/302,641 w/exhibits dated May 15, 2006 (62pgs).

Composite Catalog of Oil Field Equipment & Services, 26th Revision, 1964-65, vol. 1, Published by World Oil, p. 460: Baker Model "B" Hammer-Lok Stop Rings. (2 pages).

Kinzel, Holger and Calderoni, Angelo, "Field Test of a Downhole-Activated Centralizer To Reduce Casing Drag", Society of Petroleum Engineers, 1995 (3 pages).

Kinzel, Holger and Martens, James G., "The Application of New Centralizer Types to Improve Zone Isolation in Horizontal Wells", SPE 50438, Society of Petroleum Engineers, 1998, pp. 673-682.

* cited by examiner

DUAL DIAMETER AND ROTATING CENTRALIZER/SUB AND METHOD

CROSS REFERENCE TO RELATED APPLICATION

The present application is a divisional of patent application Ser. No. 10/302,641, filed Nov. 23, 2002, which is a continuation-in-part of application Ser. No. 09/655,795, filed Sep. 6, 2000, and having the same title, now issued as U.S. Pat. No. 6,484,803.

BACKGROUND OF THE INVENTION

The present invention relates to a centralizer for use in wellbore operations. More specifically, the present invention relates to a centralizer with movable bow springs, particularly a stabilizer that is used in relatively small annular spaces and which also expands for use in a larger annular space. In another aspect, the present invention relates to a centralizer that provides a minimum standoff and/or centralization in portions of a wellbore in which known bow spring centralizers cannot provide adequate standoff because the bow springs lack sufficient restoring force.

Bow spring centralizers are used to center one tubular member inside a borehole or other tubular member, e.g., to center a first smaller tubular member in a second larger diameter tubular member (for instance, a tubing string inside a casing in a borehole). Typically, centralizers are run into the borehole on the exterior of an inner tubular member or tubing string and the bow springs project radially outwardly from the outside diameter (O.D.), or surface, of the smaller tubular member into contact with the inside diameter (I.D.), or surface, of the larger diameter tubular. However, there are at least two disadvantages of such centralizers in that they tend to restrict fluid flow in the annular space and, in the event the smaller diameter tubular member needs to be rotated inside the larger diameter tubular member (if, for instance, it becomes stuck during running), rotating tends to damage the bow springs of such centralizers.

Another disadvantage of many known centralizers is illustrated by reference to the many wells that include a portion that is cased and a portion that is not cased, wells in which the diameter of the bore changes, or wells that include one or more lateral bores. Downhole operations are conducted in cased, uncased, different diameter, and/or lateral bores. In such wellbores, the centralizer must pass through a portion of the bore that is relatively small and then down through a portion that is smaller, with the centralizing function needed in the larger diameter, deeper portion of the wellbore. So far as is known, no centralizer is available that is capable of both being run into such bores and then also providing effective centralizing in a larger diameter portion of the wellbore. Similarly, no centralizer is known that provides effective centralizing in bores of both diameters.

Another limitation of known centralizers occurs in the curved portion of a wellbore. In such wellbores, the weight of the tubing or pipe to which the centralizer is mounted exceeds the restoring force of the bow springs such that the tubing or pipe bears against the side of the wellbore. This same problem of the weight of the tubing affects lateral bores, restricting fluid flow and preventing the rotation of the tubing string. There is, therefore, a need for, and it is an object of the present invention to provide, a centralizer that positions the tubing or pipe string off the side of the wellbore in the curved or the horizontal portion of a wellbore and a centralizer that allows rotation of the tubing string in the wellbore.

It is also an object of the present invention to provide positive centralization in areas of the wellbore where a bow spring is not strong enough to position the pipe or tubing string off the side of the well bore but also provide standoff in less severe portions of the borehole.

Another object of the present invention is to provide a centralizer that functions in both a large and/or small diameter annulus and/or wellbore.

Another object of the present invention is to provide a centralizer that maintains both standoff from the wall of the borehole and fluid flow through the borehole.

Yet another object of the present invention is to provide a centralizer that can be run into a borehole through a borehole of small diameter, e.g., a cased portion of the borehole, that also functions to center the tubing in a portion of the borehole having a diameter larger than the small diameter portion such as an uncased portion of the borehole.

Other objects, and the advantages, of the present invention will be made clear to those skilled in the art by the following description of a presently preferred embodiment thereof.

SUMMARY OF THE INVENTION

These objects are achieved by providing a centralizer sub, connectable in a tubing string, comprising a sub having at each end thereof thread means for threadably connecting the sub in a tubing string, a pair of collars rotatably mounted on the sub, a plurality of bow springs, having a relaxed and a compressed state, fixed to each of the pair of collars, and which in their compressed state, hold the collars at their furthest distance apart along the sub, a pair of shoulders, spaced apart and extending essentially around the exterior circumference of the sub, and each of the shoulders abutting a collar, restricting the axial movement of the collars when the bow springs are in their relaxed state.

In another aspect, the present invention provides a centralizer comprising a sub, a plurality of radially outwardly extending vanes on the sub, and a collar mounted on the sub. A plurality of bow springs are mounted to notches formed in the collar, the bow springs being maintained in spaced relation to the vanes whereby one or more of the bow springs moves between a first, bowed position standing off from the sub to a second compressed position between the vanes and closer to the sub. When the bow springs are compressed into the spaces between vanes, the vanes, which are not compressible under normal operating conditions, provide standoff from the wall of the hole and maintain fluid flow past the centralizer. In a particularly preferred embodiment, the vanes extend radially outwardly from the surface of the sub of the centralizer far enough that the effective diameter of the sub at the location of the vanes is larger than the diameter of the sub, thereby providing the standoff from the wall of the borehole.

DETAILED DESCRIPTION OF THE PREFERRED EMBODIMENTS

Figure 1:
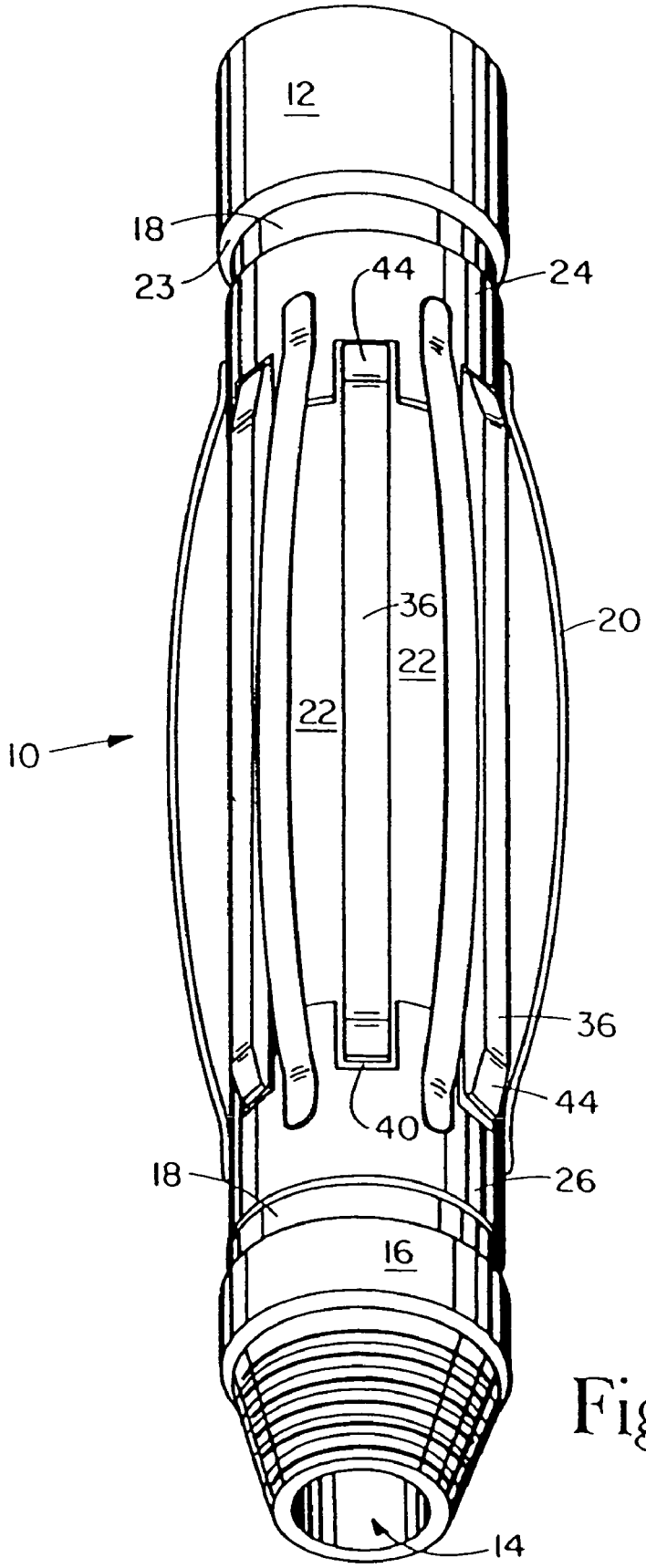
FIG. 1 is a perspective view of a preferred embodiment of a centralizer constructed in accordance with the teachings of the present invention.

Referring to FIG. 1, a preferred embodiment of a centralizer constructed in accordance with the teachings of the present invention is indicated generally at reference numeral 10. In the embodiment shown, centralizer 10 is comprised of a tubular sub 12 having a bore 14 therethrough and an outer surface, or O.D., 16. The O.D. 16 of sub 12 is provided with a groove 18 in which the first and second collars 24, 26 are movably disposed, the ends 28 of a plurality of bow springs 20 being affixed to each of collars 24, 26 by, for instance, welding or other suitable means of attachment. Bow springs 20 are spaced apart around the collars 24, 26. Although not shown in the figures, those skilled in the art who have the benefit of this disclosure will recognize that one or both of collars 24, 26 move apart from each other when the bow springs are moved from the first, bowed position standing off from said sub as shown in FIG. 1 to a second, compressed position closer to sub 12 as centralizer 10 performs its function of maintaining stand-off between a tubing string and the wall of a borehole. Depending upon the bow in bow springs 20 and the spacing between the margins of collars 24, 26, the shoulder 23 marking the change in the diameter of the O.D. 16 of sub 12 from the larger diameter portion to the smaller diameter of groove 18 functions as a stop that abuts one or both of collars 24, 26 when moved in response to contact between the bow springs 20 and the inside diameter of another member, e.g., a larger casing (not shown in FIG. 1 but described in detail in connection with FIGS. 5 and 6, infra).

Figure 3:
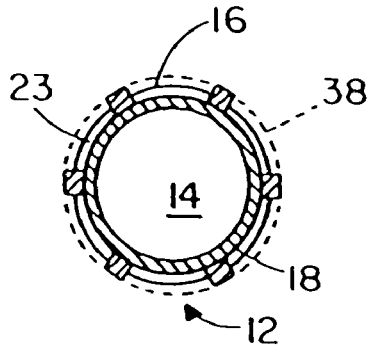
FIG. 3 is a cross-sectional view of the sub of the FIG. 2 taken at the line 3—3 in FIG. 2.
Figure 2:
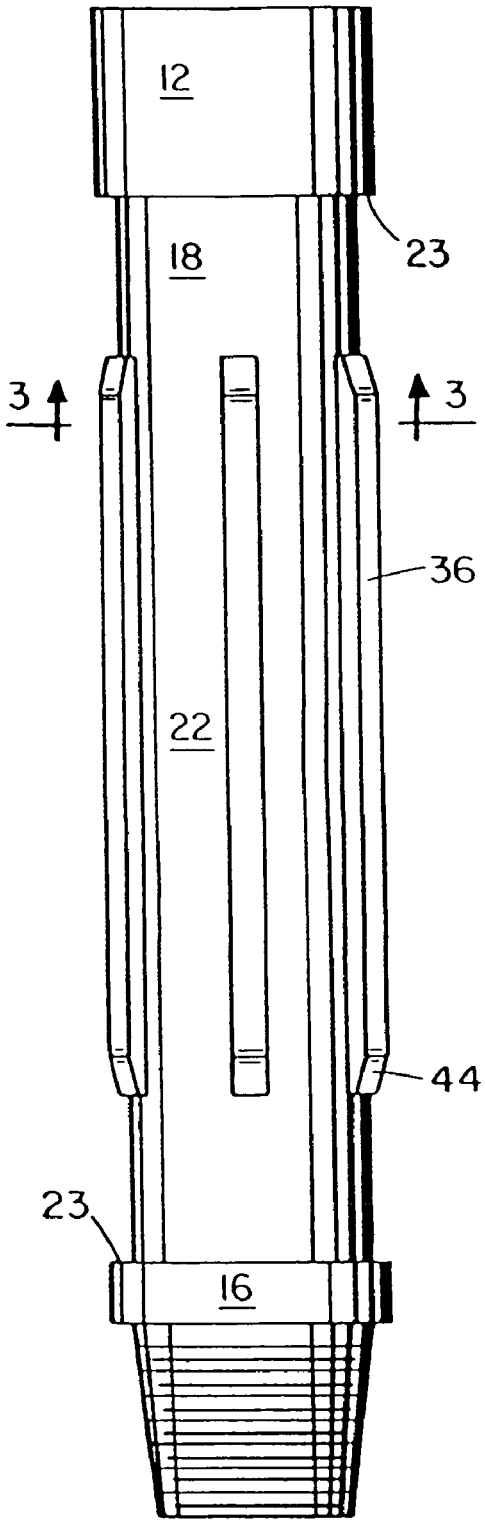
FIG. 2 is an elevational view of the sub of the centralizer of FIG. 1 having the bow springs removed therefrom to show the vanes on the outside diameter of the sub.

As shown in FIGS. 2 and 3, the sub 12 is provided with a plurality of radially outwardly extending vanes 36 on the outside surface of sub 12 in the area of groove 18. Vanes 36 may be milled into sub 12 but it is preferred (for cost saving in manufacture) to weld the vanes 36 to the surface 16 of sub 12. As best shown in FIG. 1, the spaces between vanes 36 provide grooves 22 for receipt of the bow springs 20 as bow springs 20 are compressed from the first, bowed position standing off from said sub shown in FIG. 1 to the above-described second, compressed position closer to sub 12. Although described herein as first and second positions, those who are skilled in the art will recognize from this disclosure that the designation of first and second positions for bow springs 20 is arbitrary, chosen for the purpose of facilitating the description of the grooves 22 between vanes 36, and that the position of the bow springs 20 is a continuum depending upon the degree of compression applied to bow springs 20 by contact with the inside diameter of another tubular member or a borehole. Referring now to FIG. 3, it can be seen that the vanes 36 extend radially outwardly from the surface 16 of sub 12 in the area of groove 18 far enough that the effective diameter (shown in shadow lines 38 in FIG. 3) of the sub 12 in the area to which the vanes 36 are mounted is greater than the diameter of both (a) the portion of sub 12 in the area of groove 18 and (b) the portion of sub 12 above and below groove 18 for a purpose to be explained below.

Figure 4:
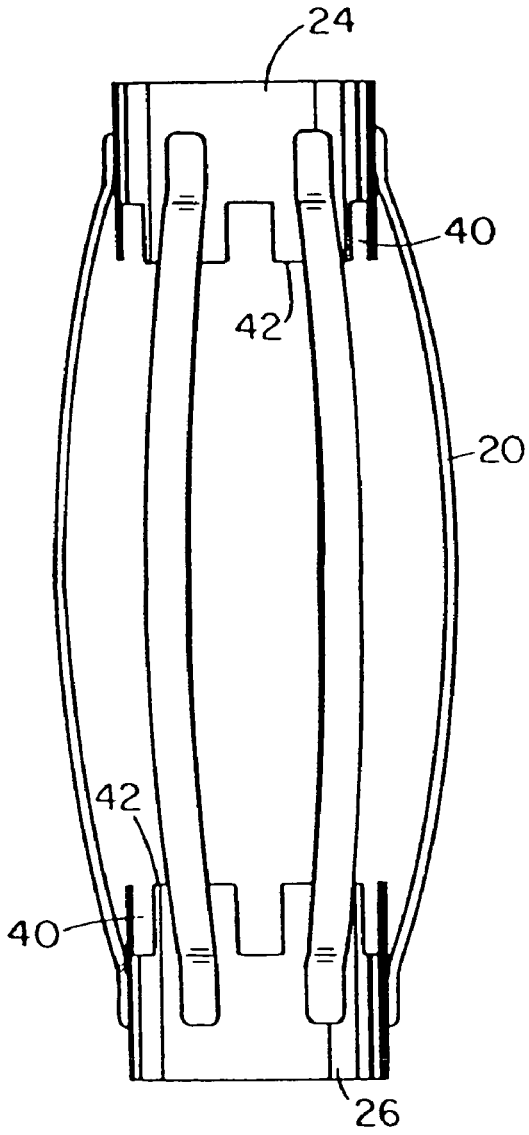
FIG. 4 is an elevational view of the bow springs of the centralizer of FIG. 1 removed from the sub thereof.

As shown in FIG. 4, the collars 24, 26 to which bow springs 20 are attached are provided with a plurality of cut-outs 40 in their opposed margins 42 such that the collars 24, 26 are castellated. Referring also to FIG. 1, it can be seen that the number of cut-outs 40 spaced radially around the opposed margins 42 of collars 24, 26 is the same as the number of vanes 36 mounted to sub 12 and that each cut-out 40 receives the end 44 of a respective vane 36, thereby preventing relative rotation between sub 12 and the assembly comprised of the bow springs 20 and collars 24, 26. Similarly, the depth of the cut-outs 40 in collars 24, 26 is such that, when the bow springs 20 move from the first, bowed position to the second position close to the sub 12 in the grooves 22 between vanes 36 and first and second collars 24, 26 move apart from each other in groove 18, the collars 24, 26 do not rotate relative to sub 12. In other words, the interaction of the ends 44 of vanes 36 and the cut-outs 40 prevents relative rotational movement between sub 12 and the bow spring 20/collar 24, 26 assembly when bow springs 20 are in both their first, bowed and their second, compressed positions.

Figure 5A:
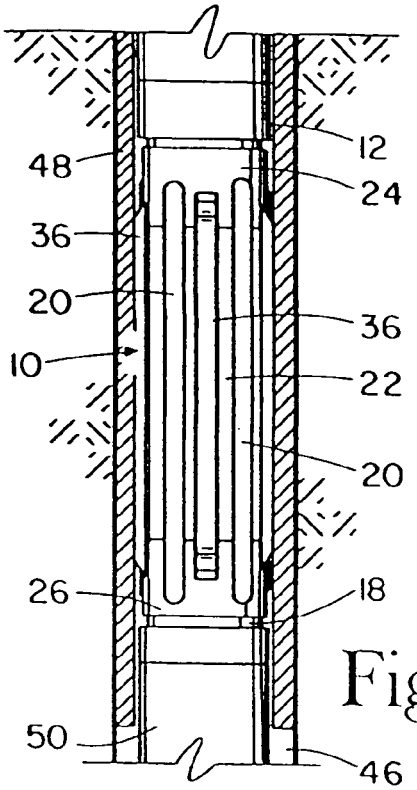
FIGS. 5A and 5B are longitudinal sectional views of a wellbore having the centralizer of FIG. 1 being run therein in casing (FIG. 5A) and without casing (FIG. 5B).
Figure 5B:
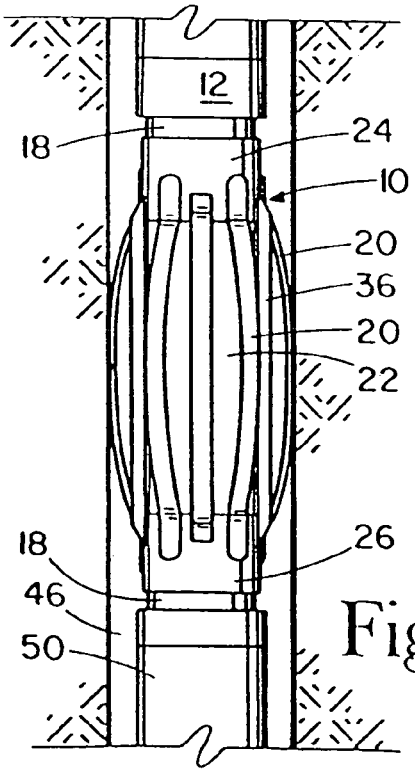

FIG. 5 shows the preferred embodiment of the centralizer 10 of the present invention being run into a cased (FIG. 5A) and uncased (FIG. 5B) borehole 46. Referring first to FIG. 5A, the bow springs 20 are compressed into the spaces 22 between vanes 36 in the area of borehole 46 that is lined with casing 48. In the portion of borehole 46 that is uncased, the bow springs 20 expand to the first, bowed position to center the tubing string 50 to which centralizer 10 is mounted in the borehole 46.

Figure 6:
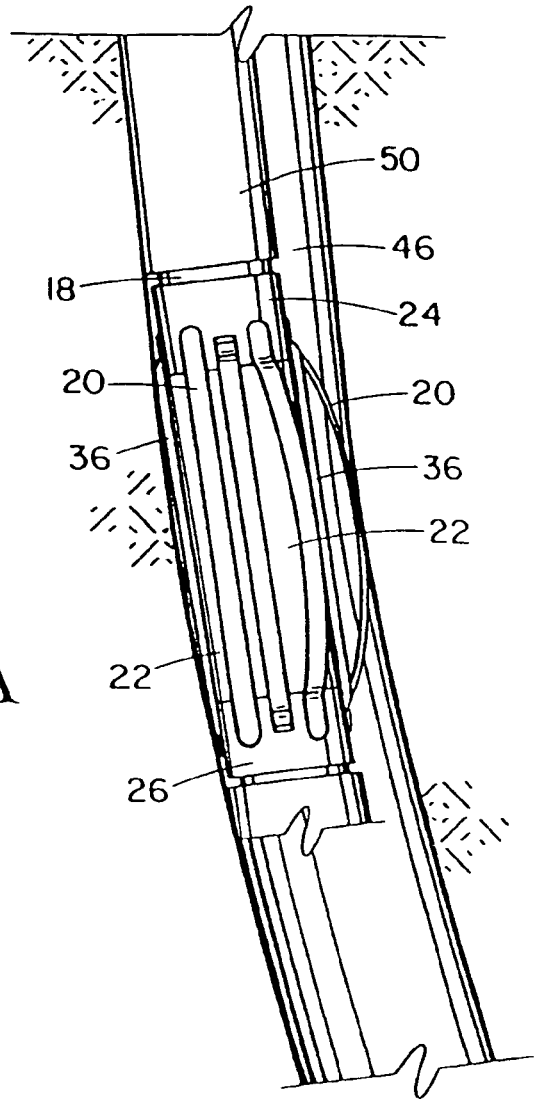
FIG. 6 is a longitudinal view of a curved portion of a wellbore having the centralizer of FIG. 1 run therein.

Referring now to FIG. 6, there is shown a curved borehole 46 (the curve is exaggerated for purposes of illustration) with a tubing string 50 therein having the preferred embodiment of the centralizer of the present invention mounted thereto. Even though the bow spring 20 is compressed into the space 22 between vanes 36 on the larger radius side of the borehole, a minimum stand-off is maintained by the bearing of the vanes 36 against the wall of the borehole on the larger radius side of borehole 46, thereby maintaining fluid flow past the centralizer 10 and reducing abrasive wear on tubing string 50. As shown by the bowed position of bow spring 20 on the shorter radius side of borehole 46, the centralizer 10 of the present invention functions to center tubing string 50 even in the curved portion of the borehole 46.

Figure 7:
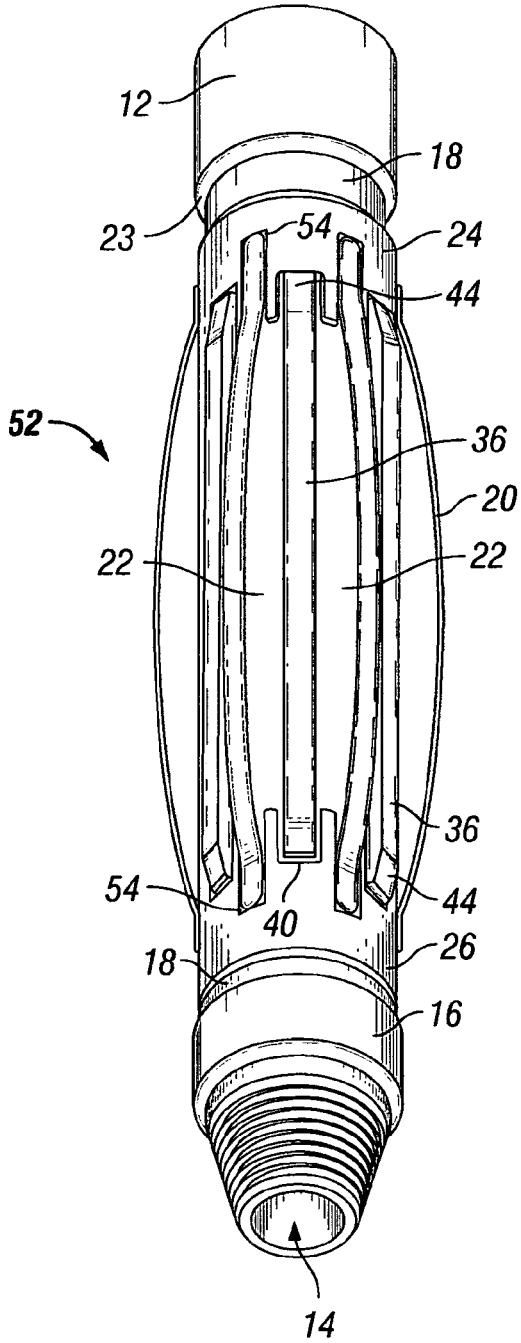
FIG. 7 is a perspective view of a second embodiment of a centralizer constructed in accordance with the teachings of the present invention.
Figure 8:
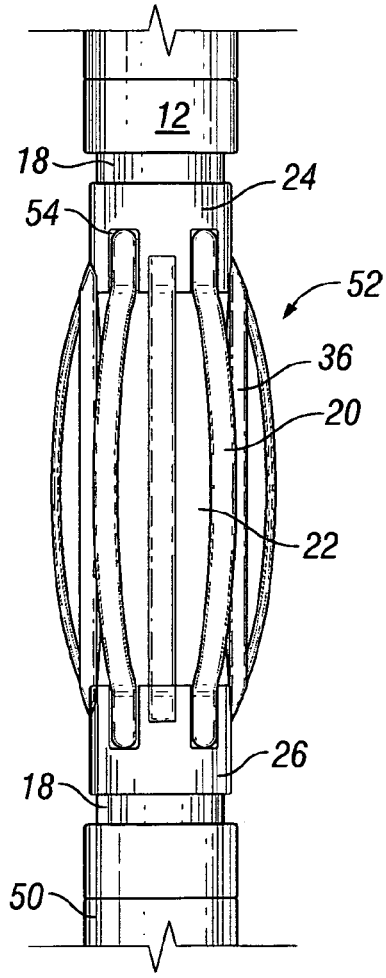
FIG. 8 is an elevational view of the centralizer of FIG. 7.

Referring now to FIGS. 7 and 8, a second embodiment of the centralizer of the present invention is shown that, because of its smaller total diameter, is particularly useful in smaller diameter boreholes and/or when avoiding a restriction in fluid flow is of paramount importance. In this second embodiment, indicated generally at reference numeral 52 and in which like parts are referred to by the same reference numerals as set out in FIGS. 1–6, the ends 28 of bow springs 20 are welded to the collars 24, 26 in the notches 54 in the opposed margins 42 of each collar 24, 26 instead of being welded to the surface, or O.D., of the first and second collars 24, 26 as in the embodiment shown in FIGS. 1–6. The result of welding the ends 28 into notches 54 is that the effective diameter of centralizer 52 is reduced (relative to the diameter of centralizer 10 shown in FIGS. 1–6) by at least the thickness of the metal comprising the collars 24, 26 for use in smaller diameter boreholes. As with the centralizer 10 shown in FIGS. 1–6, the same number of cut-outs 40 are spaced radially around the opposed margins 42 of collars 24, 26 as the number of vanes 36 that are mounted to sub 12, and each cut-out 40 receives the end 44 of a respective vane 36, thereby preventing relative rotation between sub 12 and the assembly comprised of the bow springs 20 and collars 24, 26. Similarly, the depth of the cut-outs 40 in collars 24, 26 is such that, when the bow springs 20 move from the first, bowed position to the second position close to the sub 12 in the grooves 22 between vanes 36 and first and second collars 24, 26 move apart from each other in groove 18, the collars 24, 26 do not rotate relative to sub 12. In short, relative rotational movement between sub 12 and the bow spring 20/collar 24, 26 assembly is prevented when bow springs 20 are in both their first, bowed and their second, compressed positions by the interaction of the ends 44 of vanes 36 and the cut-outs 40 in the same manner as described in connection with the embodiment 10 shown in FIGS. 1–6.

It will also be recognized by those skilled in the art that the second embodiment 52 shown in FIG. 7 can be constructed so as to allow relative rotation between sub 12, and hence, a tubing string (not shown in FIG. 7) and the assembly comprised of bow springs 20 and collars 24, 26. Referring specifically to FIG. 8, it can be seen that when the bow springs 20 are mounted in the notches 54 in collars 24, 26, the bow springs are "low enough" relative to the vanes 36 that relative rotation between sub 12 and the assembly comprised of bow springs 20 and collars 24, 26 is prevented by contact between bow springs 20 and vanes 36. Although the particular embodiment 52 shown in FIGS. 7 and 8 does include them, because the bow springs 20 contact the vanes 36, it is not necessary to include cut-outs (such as the cut-outs 40 in the opposed margins 42 of collars 24, 26 shown in FIG. 4) to prevent rotation between the bow springs/collars 24, 26 assembly and sub 12. By consideration of the embodiment shown in FIG. 8, it will be recognized that it is possible to mount the bow springs 20 to collars 24, 26 in notches 54 the extend far enough apart, and/or to bow the bow springs 20 far enough outwardly from the surface, or O.D., of sub 12 that the bow springs 20 do not contact the vanes 36 when in their first, bowed position standing off from the sub 12, thereby allowing rotation of the sub 12 relative to the collar 24, 26/bow spring 20 assembly when the bow springs 20 are in that first, bowed position. When compressed radially inwardly to the second, compressed position, the bow springs 20 of such an embodiment do contact the vanes 36 to prevent rotation of the bow spring 20/collars 24, 26 assembly relative to sub 12.

Those skilled in the art will also be aware of the utility of a centralizer that allows the tubing string to rotate relative to the bow springs at any desired time, regardless of whether the bow springs are in the first, uncompressed position or the second, compressed position. Referring now to FIGS. 9–12, four embodiments of such centralizers are shown at reference numerals 56, 58, 60, and 64, respectively. Again, like parts shown in FIGS. 7–8, the component parts of the rotating bow spring centralizers shown in FIGS. 9–12 are numbered in accordance with the reference numerals of the embodiments shown in FIGS. 1–6. In the embodiment shown in FIG. 9, the assembly comprised of the bow springs 20 and collars 24, 26 is mounted to body 12 and retained thereon by engagement of the opposed margins 42 of collars 24, 26 with the shoulders 62 on the O.D. of sub 12. The centralizer 56 shown in FIG. 9 functions to centralize the tubing string (not shown) in a borehole in the same manner as the embodiments shown in FIGS. 1–8, but the assembly comprised of bow springs 20 and collars 24, 26 is free to rotate around the sub 12 at all times, thereby allowing rotation of the tubing string, regardless of whether the bow springs 20 are in the first or second positions, while maintaining the required stand-off from the I.D. of the borehole. It will be recognized by those skilled in the art that the shoulders 62 need not extend all the way around the O.D. of sub 12 to function for their intended purpose of preventing movement of the bow spring 20/collars 24, 26 assembly along the longitudinal axis of sub 12. It will also be recognized that the shoulders 62 need not be milled into sub 12 and that the shoulders can also be formed by the "step-down" from an enlarged portion of sub 12 that extends from opposed margin 42 to opposed margin 42 of the collars 24, 26 to the smaller diameter portion of sub 12 on which the collars 24, 26 ride. Note also that the shoulders 62 need not be an integral part of sub 12, and that they can be mounted to sub 12 in a manner in which they are removable therefrom, being secured to sub 12 by a suitable fastener.

Figure 9:
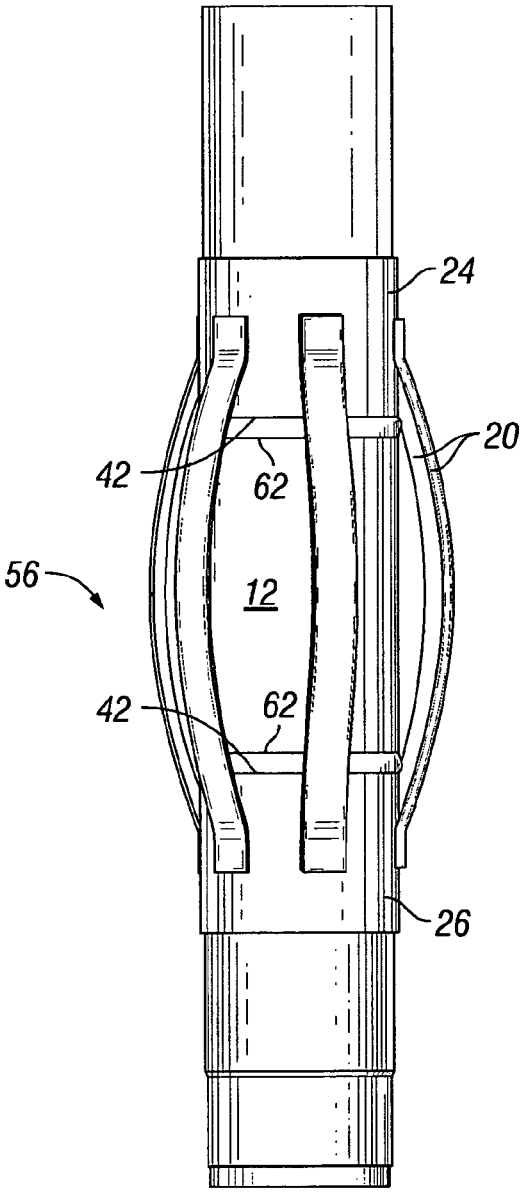
FIG. 9 is an elevational view of a first embodiment of a rotating bow spring centralizer constructed in accordance with the teachings of the present invention.
Figure 10:
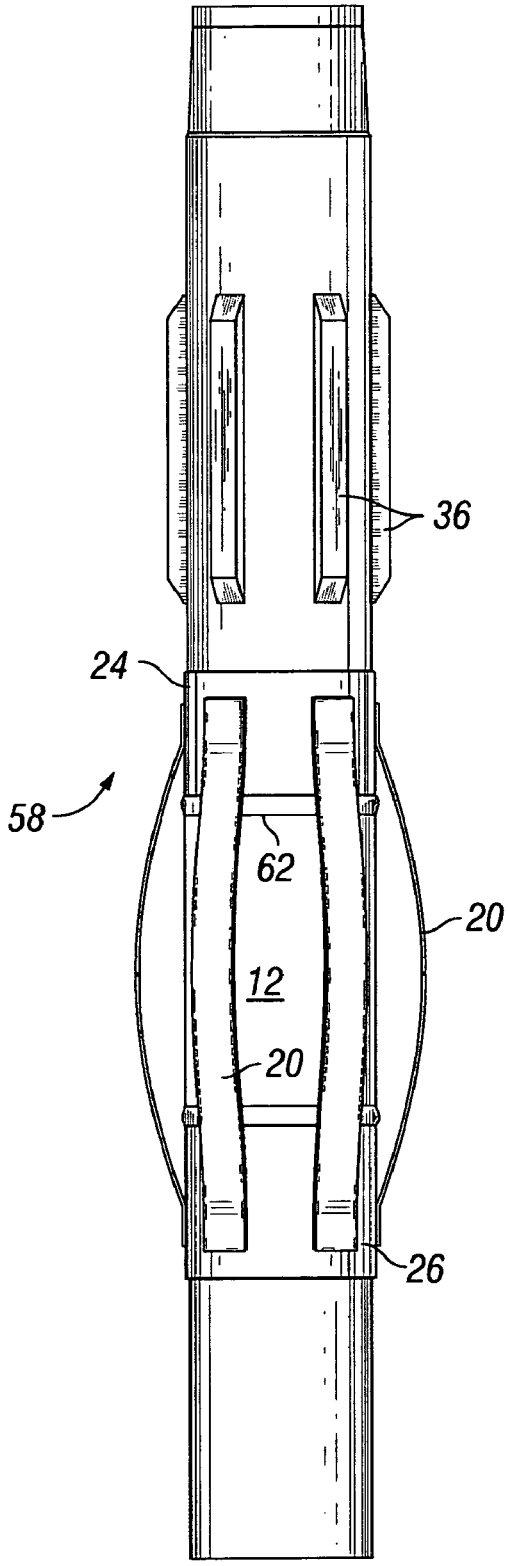
FIG. 10 is an elevational view of a second embodiment of a rotating bow spring centralizer constructed in accordance with the teachings of the present invention.

The embodiment 58 shown in FIG. 10 includes the same rotating bow spring assembly as shown in FIG. 9, but the rotating bow spring assembly (comprised of collars 24, 26 and bow springs 20) is spaced longitudinally on the sub 12 from the set of vanes 36 that are mounted to the O.D. of sub 12. The collar 24, 26/bow spring 20 assembly is retained in this longitudinally spaced position on sub 12 by engagement of the shoulders 62 formed on sub 12 by the opposed margins 42 of collars 24, 26 in the same manner as described above in connection with the embodiment shown in FIG. 9. Because of the presence of both the bow springs 20 and the vanes 36, the embodiment 58 shown in FIG. 10 is capable of performing in the same manner as the embodiment shown in FIGS. 1–6 to maintain fluid flow and stand-off from the I.D. of the borehole, but has the additional advantage of allowing rotation of the sub 12 (and hence a tubing string) relative to the centralizer 58. Similarly, the embodiment 60 shown in FIG. 11 includes the same component parts as the embodiment 58 shown in FIG. 10, but the vanes 36 of the centralizer 60 are angled and spiraled so as to "turbolate" fluid flow past the centralizer 60, thereby assisting in maintaining fluid flow in the borehole. The vanes 36 are angled at an angle ranging from about 15° to about 45° relative to the longitudinal axis of sub 12.

Figure 12:
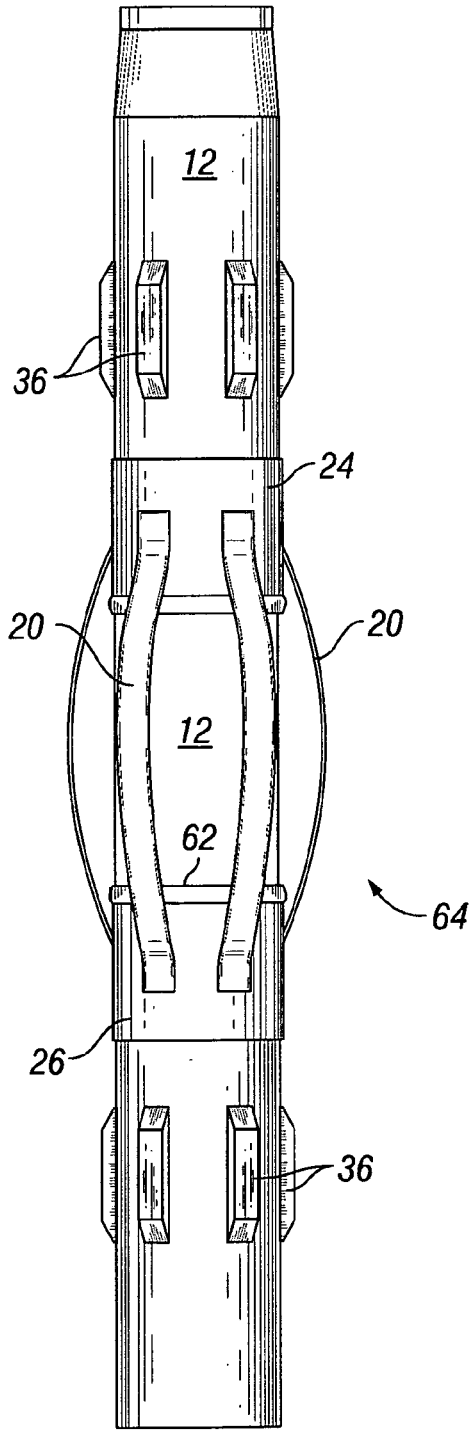
FIG. 12 is an elevational view of a fourth embodiment of a rotating bow spring centralizer constructed in accordance with the teachings of the present invention.
Figure 11:
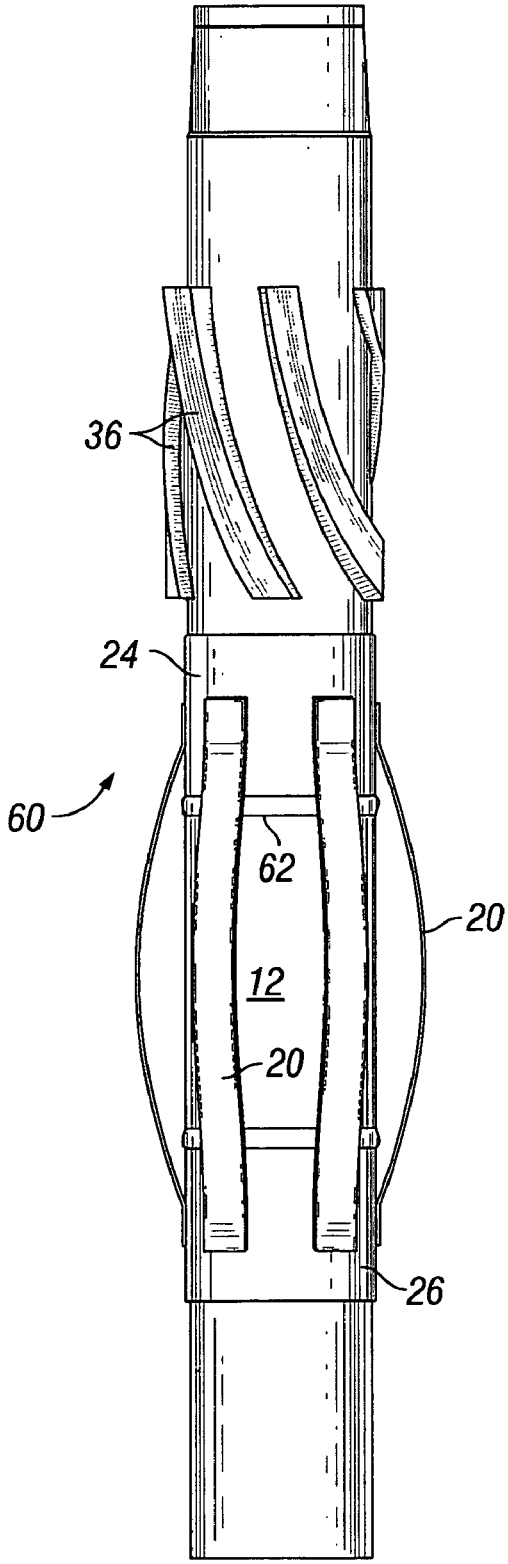
FIG. 11 is an elevational view of a third embodiment of a rotating bow spring centralizer constructed in accordance with the teachings of the present invention.

The embodiment 64 shown in FIG. 12 is similar to the embodiments shown in FIGS. 10 and 11, but is comprised of two sets of vanes 36 having the assembly comprised of bow springs 20 and collars 24, 26 mounted to the sub 12 between the two sets of vanes 36. Those skilled in the art who have the benefit of this disclosure will recognize that the vanes 36 of the embodiment 64 could also be angled with respect to the longitudinal axis of sub 12 in the same manner as the vanes 36 of the centralizer 58 shown in FIG. 11. Although shown in FIG. 12 as being retained in that longitudinally spaced position between the two sets of vanes 36 by the interaction of the opposed margins 42 of collars 24, 26 and shoulders 62, those skilled in the art will recognize that the shoulders 62 are not required for that purpose and that the collar/bow spring assembly is effectively trapped between the sets of vanes 36 by the interaction of the ends of the collars 24, 26 and the ends 44 of the vanes 36.

Those skilled in the art who have the benefit of this disclosure will recognize that certain changes can be made to the component parts of the apparatus of the present invention without changing the manner in which those parts function to achieve their intended result. For instance, although the vanes 36 are described herein as being welded to the outside surface 16 of sub 12 of the centralizer of the present invention such that it is clear that in the presently preferred embodiment, the vanes 36 are comprised of relativley incompressible metal, those skilled in the art who have the benefit of this disclosure will recognize that vanes 36 may also be comprised of materials other than metal. Further, in certain applications, it may be advantageous to make the vanes 36 of a material that is slightly compressible or even elastically deformable when compressive forces are exerted against the vanes. A variety of polymeric materials are available, for instance, that are high temperature tolerant, or acid resistant, or have other desirable physical properties that will enable them to serve this function. Those skilled in the art who have the benefit of this disclosure will also recognize that, although the preferred embodiment of the centralizer of the present invention has been described herein as being used in a wellbore, the use of the centralizer of the present invention is not so limited. A centralizer constructed in accordance with the teachings of the present invention may be used in any application in which it is desirable to maintain minimum standoff between two concentric tubular members and/or center one tubular member inside another.

Similarly, U.S. Pat. No. 5,575,333 discloses several embodiments of a bow spring centralizer that vary, inter alia, in the configuration of the bow springs and their attachment to the sub of the centralizer. To illustrate how the structure disclosed in that patent can be incorporated into the centralizer of the present invention, one embodiment of the centralizer disclosed in that patent lacks collars altogether, the bow springs being attached directly to the outside surface of the sub of the centralizer and the ends of the bow springs moving in grooves when the bow springs are compressed. Similar grooves can be provided in the surface 16 of the sub 12 of the centralizer of the present invention for receiving the bow springs 20 described herein. Those skilled in the art will recognize that the other structural variations shown in that patent can also be utilized in connection with the centralizer of the present invention. For that reason, U.S. Pat. No. 5,575,333 is incorporated into this specification in its entirety by this reference thereto. Similarly, those skilled in the art will recognize that, as also described in that same U.S. Pat. No. 5,575,333, the centralizer of the present invention will function for its intended purpose with but one of the two collars 24, 26. Likewise, U.S. Pat. No. 3,556,042 discloses a bow spring centralizer in which the collar/bow spring assembly is provided with slightly-bowed so-called inner strips that connect the collars under the bow springs so that compression of the bow springs is resisted. That same patent also discloses a centralizer having a bow spring with a double arc that is used to advantage in connection with the centralizer of the present invention. Because of this disclosure, U.S. Pat. No. 3,556,042 is also incorporated into this specification in its entirety by this specific reference thereto. The alternative embodiments resulting from the incorporation of the structural features of these two patents that are incorporated herein by reference, and other changes that will be made clear to those skilled in the art by this description of the preferred embodiments of the invention, are intended to fall within the scope of the following, non-limiting claims.

What is claimed is:

1. A centralizer comprising:

a sub;

a plurality of radially outwardly extending vanes on said sub;

a collar mounted on said sub and having a plurality of notches formed therein; and a plurality of bow springs mounted to said collar, each of said bow springs being mounted to said collar in a respective one of the notches formed therein, said bow springs being maintained in spaced relation to said vanes whereby one or more of said bow springs moves between a first, bowed position standing off from said sub to a second compressed position between said vanes and closer to said sub.

2. The centralizer of claim 1 additionally comprising a second collar having a plurality of notches formed therein, said bow springs also being mounted in the notches formed in said second collar.

3. The centralizer of claim 2 wherein said bow springs are held in spaced relationship to said vanes by the interaction of said collars with said vanes.

4. The centralizer of claim 3 additionally comprising a plurality of cut-outs on one or both of said collars for interacting with said vanes by receiving one or both ends of said vanes therein.

* * * * *